US005195478A

United States Patent [19]

Kawabata et al.

[11] Patent Number: 5,195,478

[45] Date of Patent: Mar. 23, 1993

[54] PISTON FOR AN INTERNAL COMBUSTION ENGINE

[75] Inventors: Yasuhiro Kawabata, Anjo; Soichi Hara; Hiroshi Kageyama, both of Toyota; Toshiaki Konomi; Motoichi Murakami, both of Susono, all of Japan

[73] Assignees: Aisin Seiki Kabushiki Kaisha, Kariya; Toyota Jidosha Kabushiki Kaisha, Toyota, both of Japan

[21] Appl. No.: 766,379

[22] Filed: Sep. 27, 1991

[30] Foreign Application Priority Data

Sep. 27, 1990 [JP] Japan ..... 2-101253[U]
Jun. 4, 1991 [JP] Japan ..... 3-050185[U]

[51] Int. Cl.[5] ..... F02F 1/00

[52] U.S. Cl. ..... 123/193.4; 92/212; 29/888.048

[58] Field of Search ..... 123/193.4; 92/212, 222, 92/232, 223, 234, 158, 159; 29/888.04, 888.048

[56] References Cited

U.S. PATENT DOCUMENTS

| | | | |
|---|---|---|---|
| 2,197,942 | 4/1940 | Over | 92/234 |
| 2,806,751 | 9/1957 | Sykes | 92/212 |
| 2,817,562 | 12/1957 | Fleming et al. | 92/212 |
| 3,995,538 | 12/1976 | Beardmore et al. | 92/212 |
| 4,395,442 | 7/1983 | Meise et al. | 29/888.048 |
| 4,519,119 | 5/1985 | Nakayama et al. | 92/223 |

FOREIGN PATENT DOCUMENTS

| | | |
|---|---|---|
| 54-162014 | 12/1979 | Japan . |
| 60-65360 | 5/1985 | Japan . |
| 63-110766 | 7/1988 | Japan . |
| 2-117072 | 9/1990 | Japan . |
| 2-126058 | 10/1990 | Japan . |

*Primary Examiner*—Noah P. Kamen
*Attorney, Agent, or Firm*—Oblon, Spivak, McClelland, Maier & Neustadt

[57] ABSTRACT

Disclosed is a piston for an internal combustion engine, which includes a land portion, and a skirt portion including a non-coated portion which is formed in an arbitrary shape on a sliding portion thereof and a coated portion which is formed on a sliding portion thereof other than the sliding portion on which the non-coated portion is formed. When the piston is descending, an oil which has adhered on a cylinder bore is introduced into the non-coated portion and accordingly an oil film is established in the non-coated portion. Since the advantageous effects of the coated portion and the oil film are combined in the piston, the sliding resistance can be reduced remarkably. Hence, the coated portion can be inhibited from wearing out, and its function of the sliding resistance reduction can be maintained for a long period of time. In addition, since the non-coated portion does not work as a sliding surface, there arises a reduced sliding surface area which also results in the reduction of the sliding resistance. The non-coated portion and the coated portion can be formed with a resin by printing. If such is the case, they can be formed with ease and at a less production cost.

17 Claims, 2 Drawing Sheets

PISTON FOR AN INTERNAL COMBUSTION ENGINE

BACKGROUND OF THE INVENTION

1. Field of the Invention

The present invention relates to a piston for an internal combustion engine.

2. Description of the Prior Art

A piston for an internal combustion engine has been proposed in Japanese Unexamined Patent Publication (KOKAI) No. 162014/1979. The piston includes a resin coating which is provided on an entire sliding surface of a skirt portion thereof.

Further, another piston for an internal combustion engine has been proposed in Japanese Unexamined Utility Model Publication (KOKAI) No. 65360/1985. The piston includes slits which are formed in a resin coated surface. The resin coated surface covers an entire sliding surface of a skirt portion of the piston, and the slits are adapted to be non resin coated portions in the resin coated surface.

The first conventional piston which includes the resin coating provided on the entire sliding surface of the skirt portion is effective in the reduction of the sliding resistance. However, since the resin is far inferior to aluminum, i.e., the mother material of the first conventional piston, in hardness and the thermal resistance, the resin coating loses the function of the sliding resistance reduction when it is worn out. The resin coating is worn out because of the following reason. Namely, since the entire sliding surface of the skirt portion is coated with the resin coating, the piston comes to be operated without a lubricating oil. In other words, when the piston is operated, for instance, under a high temperature and high load condition, the mother material expands thermally so that there is no clearance between the piston and a cylinder bore. Accordingly, an oil film is more likely to break up. Thus, the resin coating is worn out rapidly when it is subjected to the above operating condition.

The second conventional piston includes the slits which are non resin coated portions in the resin coated surface. It is believed that the slits are formed by machining, etching, or the like. However, such a process for forming the slits requires a very time-consuming operation, and accordingly it results in an increased production cost.

SUMMARY OF THE INVENTION

It is therefore a major object of the present invention to provide a piston for an internal combustion engine, in which a coated portion and a non-coated portion are formed on a skirt portion thereof so that an oil film is established in the non-coated portion, and which is inhibited from scuffing and seizing by both of the coated portion and the oil film established in the non-coated portion.

It is a further object of the present invention to provide a piston for an internal combustion engine, in which a coated portion and a non-coated portion are formed on a skirt portion thereof by printing so that an oil film is established in the non-coated portion, and which is inhibited from scuffing and seizing by both of the coated portion and the oil film established in the non-coated portion.

In a first aspect of the present invention, there is provided a piston for an internal combustion engine according to the present invention, which comprises:

a land portion; and a skirt portion including a non-coated portion which is formed in an arbitrary shape on a sliding portion thereof and a coated portion which is formed on a sliding portion thereof other than the sliding portion on which the non-coated portion is formed.

In a second aspect of the present invention, there is provided a piston for an internal combustion engine according to the present invention, which comprises:

a land portion; and a skirt portion including a non-coated portion and a coated portion, the non-coated portion formed on a sliding portion thereof and including a plurality of streaks which are formed in curves parallelly and independently of each other, which extend upward from a lower end portion of the skirt portion to a central portion thereof and which are disposed on both sides thereof when the skirt portion is viewed laterally, the coated portion formed on a sliding portion thereof other than the sliding portion on which the non-coated portion is formed.

Further, the non-coated portion can be formed on a sliding portion of the skirt portion, and it can include a plurality of streaks which are formed in arcs parallelly and independently of each other and which extend downward from aN upper end portion and upward from a lower end portion of the skirt portion to a central portion thereof when the skirt portion is viewed laterally. Furthermore, the non-coated portion and the coated portion can be formed by printing. Moreover, the coated portion can be formed of a resin. In addition, it is preferred that the non-coated portion is formed in a groove shape, and that non-coated portion has a radial depth of 2 through 20 micrometers and the coated portion has a radial thickness of 2 through 20 micrometers.

The piston includes the coated portion and the non-coated portion which are formed on the skirt portion, and the piston thus constructed operates as follows. When the piston is descending, an oil which has adhered on a cylinder bore is introduced into the non-coated portion which is depressed in a groove shape. Hence, there arises a synergetic advantageous effect in which the advantageous effects of the coated portion and the oil film established in the non-coated portion are combined, whereby the sliding resistance can be reduced. Accordingly, the coated portion is inhibited from wearing out, and its function of the sliding resistance reduction is maintained for a long period of time. In addition, since the non-coated portion does not work as a sliding surface, there arises a reduced sliding surface area which also results in the reduction of the sliding resistance.

As having been described so far, the thus constructed piston according to the present invention draws the oil which has adhered on the cylinder bore into the non-coated portion, and it establishes the oil film in the non-coated portion. Accordingly, the sliding resistance can be reduced further by the synergetic advantageous effect than by the advantageous effects of the conventional pistons. The synergetic effect is a combination of the advantageous effects of the coated portion and the oil film established in the non-coated portion. Namely, the lubricating oil is supplied to the sliding surface of the coated portion by the oil film established in the non-coated portion in a much greater amount than those supplied by the constructions of the conventional pistons. Accordingly, the frictional force can be further reduced, the wear can be further suppressed, and the scuffing and the seizing can be further inhibited. Hence, the coated portion is maintained for a long period of time. In addition, since the non-coated portion does not work as a sliding surface, there arises an additional sliding resistance reduction effect. Namely, as illustrated in FIG. 4, the sliding resistance of the piston according to the present invention is far less than that of a piston in which no coating is carried out on a sliding portion of the skirt portion, and it is less than that of the first conventional piston which includes the resin coating provided on the entire sliding surface of the skirt portion.

Moreover, according to the second aspect of the present invention, the non-coated portion can be formed on a sliding portion of the skirt portion so as to include a plurality of streaks which are formed in curves parallelly and independently of each other, which extend upward from a lower end portion of the skirt portion to a central portion thereof and which are disposed on both sides thereof when the skirt portion is viewed laterally, or the non-coated portion can be formed on a sliding portion of the skirt portion so as to include a plurality of streaks which are formed in arcs parallelly and independently each other and which extend downward from an upper end portion and upward from a lower end portion of the skirt portion to a central portion thereof when the skirt portion is viewed laterally. Therefore, the thus constructed non-coated portion establishes the oil film more reliably than the cases where the non-coated portion is formed only one of the right-hand side and left-hand side sections of the skirt portion or only one of the upper and lower sections thereof. In addition, the coated portion and the non-coated portion can be formed by printing. Therefore, there occur no problems that the formation of the non-coated portion and the coated portion is as hard as the conventional process for forming the slits such as machining, etching, or the like, and that it leads to an increasing production cost. Thus, the present invention provides another advantageous effect that the non-coated portion and the coated portion can be formed with ease and at a production cost as less as the case where the entire sliding surface of the skirt portion is coated with a resin.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for purposes of illustration only and are not intended to limit the scope of the appended claims.

First Preferred Embodiment

Figure 1:
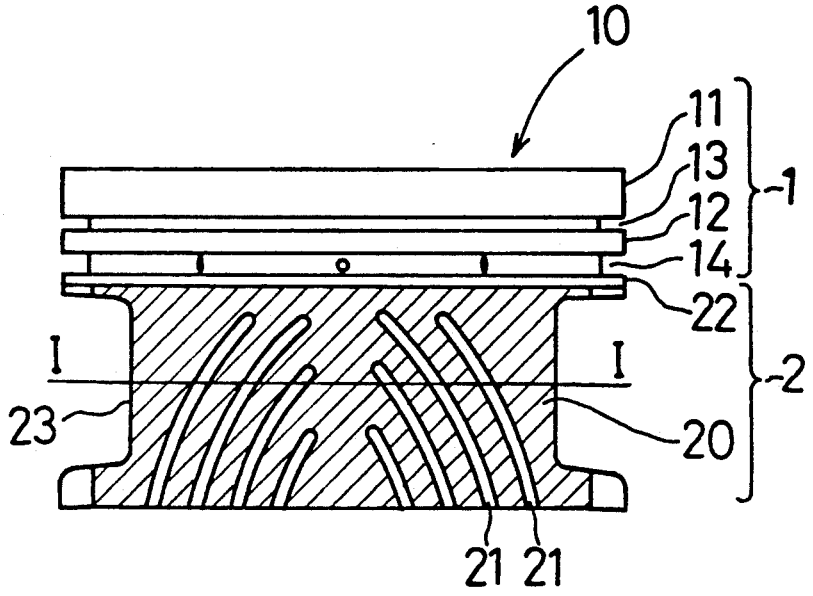
FIG. 1 is a lateral view of a piston for an internal combustion engine of a First Preferred Embodiment according to the present invention.
Figure 2:
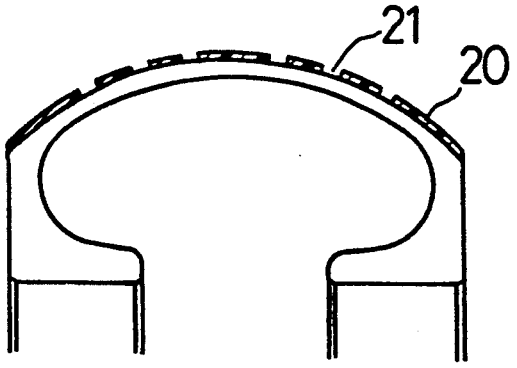
FIG. 2 is a cross sectional view of the piston taken along the line "I—I" of FIG. 1.

Referring now to FIGS. 1 and 2, the piston for an internal combustion engine of the First Preferred Embodiment according to the present invention will be hereinafter described. The piston 10 comprises a land portion 1 and a skirt portion 2. The land portion 1 includes a top land 11, a second land 12, a ring-shaped groove 13 which is formed between the top land 11 and the second land 12, and a ring-shaped groove 14 which is formed between the second land 12 and an upper end shoulder 22 of the skirt portion 2. The skirt portion 2 includes the upper end shoulder 22 and side cut-offs 23. The side cut-offs 23 are non-sliding surfaces, and they are equipped with a pin (not shown).

Non-coated portions 21 are formed on a sliding surface of the skirt portion 2, and a resin coated portion 20 is formed on a sliding surface of the skirt portion 2 other than the sliding surface of the skirt portion 2 on which the non-coated portions 21 are formed. The resin coated portion 20 is formed of a resinous raw material which comprises Teflon (a trade mark of a polytetrafluoroethylene polymer). As illustrated in FIG. 1, the non-coated portions 21 include a plurality of streaks which are formed in curves parallelly and independently of each other. The streaks extend upward from a lower end portion of the skirt portion 2 to a central portion thereof, and they are disposed on both sides of the skirt portion 2 when the skirt portion 2 is viewed laterally. Further, identical resin coated portion 20 and non-coated portions 21 are formed on the opposite side of the skirt portion 2 of the piston 10, i.e., on the rear surface of the skirt portion 2 of FIG. 1. The resin coated portion 20 has a radial thickness of approximately 10 micrometers. The non-coated portions 21 are formed in a groove shape, and have a radial depth of approximately 10 micrometers. In addition, the resin coated portion 20 can be replaced with a coated portion which is formed of a metal such as molybdenum, or the like.

Though the non-coated portions 21 are formed as described above and as illustrated in FIG. 1 in the piston of the First Preferred Embodiment according to the present invention, they can be formed in independent dots, horizontal streaks which are disposed parallelly, or the like. The non-coated portions 21 operate to establish the oil film effectively even when they are formed in any shape.

The formation of the resin coated portion 20 will be hereinafter described. The resin coated portion 20 is formed by a general printing. In the course of the printing, the portions to be made into the non-coated portions 21 can be covered with a film which is repellent to resins or which is hardly covered with resins in advance, and then the entire surface of the skirt portion can be covered with the resinous raw material. Thus, the resin coated portion 20 and the non-coated portions 21 can be formed. Further, in the course of the printing, the portions to be made into the non-coated portions 21 can be covered with a masking stencil or screen in advance, and then the resinous raw material can be printed or coated through openings of the masking stencil or screen to form the resin coated portion 20. Furthermore, the resin coated portion 20 can be formed by spray painting. However, it is hard to apply masking on the portions to be made into non-coated portions 21 having a complicated shape in the course of the spray painting, and consequently the spray painting results in an increased production cost.

In the case that an internal combustion engine employs the piston 10 of the First Preferred Embodiment according to the present invention which includes the resin coated portion 20 and the non-coated portions 21 formed on the skirt portion 2, an oil which has adhered on a cylinder bore of the internal combustion engine is introduced into the non-coated portions 21 which are depressed in a groove shape when the piston 10 is descending. Accordingly, the construction of the piston 10 of the First Preferred Embodiment can supply the oil to the sliding surface in a much greater amount than the construction of the first conventional piston which includes the resin coating provided on the entire sliding surface of the skirt portion does. Hence, the sliding resistance can be reduced by both of the resin coated portion 20 and the oil films established in the non-coated portions 21. In short, as can be understood from FIGS. 1 and 2, there arises a synergetic advantageous effect in which the advantageous effects of the resin coated portion 20 and the oil films established in the non-coated portions 21 are combined. As a result, the oil is always supplied onto the surface of the resin coated portion 20. Therefore, it is readily understood that the advantageous effect, i.e., the sliding resistance reduction effect, of the resin coated portion 20 can be enhanced more than that of the first conventional piston which includes the resin coating provided on the entire sliding surface of the skirt portion.

Second Preferred Embodiment

Figure 3:
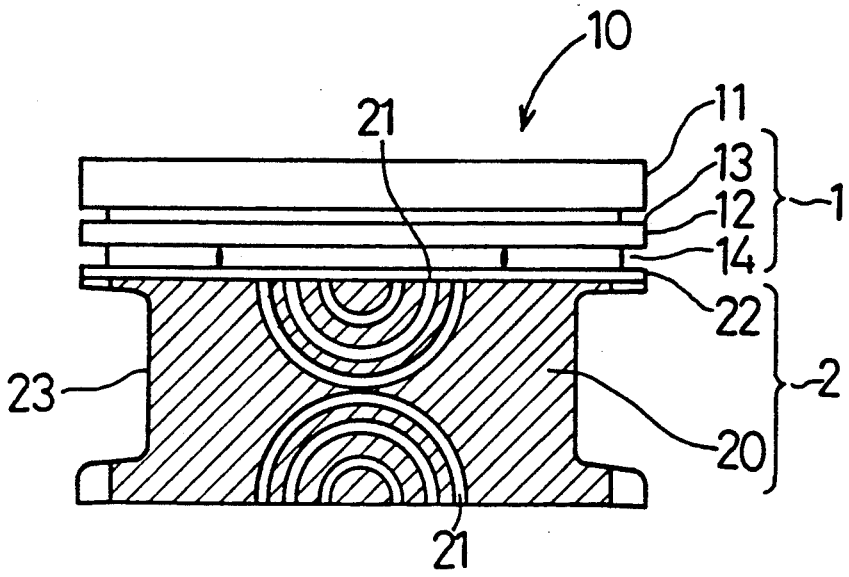
FIG. 3 is a lateral view of a piston for an internal combustion engine of a Second Preferred Embodiment according to the present invention.
Figure 4:
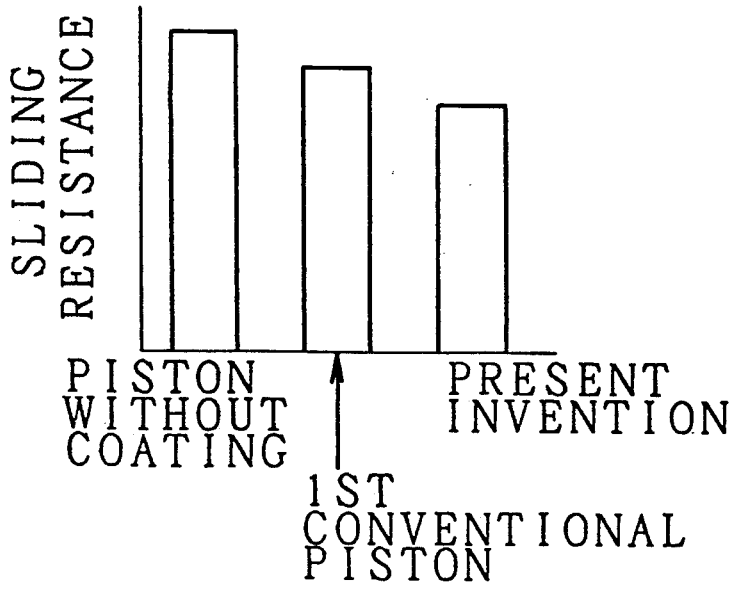
FIG. 4 is a column chart for comparing the sliding resistances which are exhibited by a piston for an internal combustion engine according to the present invention, the first conventional piston therefor and a piston therefor which is free from any coating.

Turning now to FIG. 3, the piston for an internal combustion engine of the Second Preferred Embodiment according to the present invention will be hereinafter described. The piston 10 of the Second Preferred Embodiment has an identical construction with that of the piston 10 of the First Preferred Embodiment basically, but it has a resin coated portion 20 and non-coated portions 21 of different shapes.

Namely, as illustrated in FIG. 3, the non-coated portions 21 include a plurality of streaks which are formed in arcs parallelly and independently of each other. The streaks extend downward from an upper end portion and upward from a lower end portion of the skirt portion 2 to a central portion thereof when the skirt portion 2 is viewed laterally. The resin coated portion 20 is formed on a sliding surface of the skirt portion 2 other than the sliding surface of the skirt portion 2 on which the non-coated portions 21 are formed. The resin coated portion 20 and the non-coated portions 21 are formed by printing, and various techniques can be employed in the course of the printing as set forth in the "First Preferred Embodiment" section. Likewise, identical resin coated portion 20 and non-coated portions 21 are formed on the rear surface of the skirt portion 2 of the piston 10 which is illustrated in FIG. 3.

The thus constructed piston 10 of the Second Preferred Embodiment according to the present invention operates and effects advantages in the same manner as that of the First Preferred Embodiment when it is employed in an internal combustion engine. Hence, the operation and advantageous effects of the piston 10 of the Second Preferred Embodiment will not be described herein.

Having now fully described the present invention, it will be apparent to one of ordinary skill in the art that many changes and modifications can be made thereto without departing from the spirit or scope of the present invention as set forth herein including the appended claims.

What is claimed is:

1. A piston for an internal combustion engine, comprising:

a land portion; and a skirt portion including a non-coated portion and a coated portion, said non-coated portion formed on a sliding portion thereof and including a plurality of streaks which are formed in curves parallelly and independently of each other, which extend upward from a lower end portion of the skirt portion to a central portion thereof and which are disposed on both sides thereof when the skirt portion is viewed laterally, the coated portion formed on a sliding portion thereof other than the sliding portion on which the non-coated portion is formed.

2. The piston for an internal combustion engine according to claim 1, wherein said non-coated portion and said coated portion are formed by printing.

3. The piston for an internal combustion engine according to claim 1, wherein said coated portion comprises a resin.

4. The piston for an internal combustion engine according to claim 3, wherein said resin is a fluororesin.

5. The piston for an internal combustion engine according to claim 4, wherein said fluororesin is a polytetrafluoroethylene polymer.

6. The piston for an internal combustion engine according to claim 1, wherein said non-coated portion has a radial depth of 2 through 20 micrometers and said coated portion has a radial thickness of 2 through 20 micrometers.

7. A piston for an internal combustion engine, comprising:

a land portion; and a skirt portion including a non-coated portion and a coated portion, said non-coated portion formed on a sliding portion thereof and including a plurality of streaks which are formed in arcs parallelly and independently of each other and which extend downward from an upper end portion of the skirt portion and upward from a lower end portion thereof to a central portion thereof when the skirt portion is viewed laterally, the coated portion formed on a sliding portion thereof other than the sliding portion on which the non-coated portion is formed.

8. The piston for an internal combustion engine according to claim 7, wherein said non-coated portion and said coated portion are formed by printing.

9. The piston for an internal combustion engine according to claim 7, wherein said coated portion comprises a resin.

10. The piston for an internal combustion engine according to claim 9, wherein said resin is a fluororesin.

11. The piston for an internal combustion engine according to claim 10, wherein said fluororesin is a polytetrafluoroethylene polymer.

12. The piston for an internal combustion engine according to claim 7, wherein said non-coated portion has a radial depth of 2 through 20 micrometers and said coated portion has a radial thickness of 2 through 20 micrometers.

13. A piston for an internal combustion engine, comprising:

a land portion; and a skirt portion including a non-coated portion which is formed in an arbitrary shape on a sliding portion thereof and a coated portion which is formed on a sliding portion thereof other than the sliding portion on which the non-coated portion is formed, wherein said non-coated portion includes a plurality of streaks which are formed parallelly and independently of each other, and which are disposed symmetrically on both sides of said skirt portion when said skirt portion is viewed laterally, wherein said streaks are formed in curves and extend upward from a lower end portion of said skirt portion to a central portion thereof when said skirt portion is viewed laterally.

14. A piston for an internal combustion engine, comprising:

a land portion; and a skirt portion including a non-coated portion which is formed in an arbitrary shape on a sliding portion thereof and a coated portion which is formed on a sliding portion thereof other than the sliding portion on which the non-coated portion is formed, wherein said non-coated portion includes a plurality of streaks which are formed parallelly and independently of each other, and which are disposed symmetrically on both upper and lower end portions of said skirt portion when said skirt portion is viewed laterally.

15. A piston for an internal combustion engine, comprising:

a land portion; and a skirt portion including a non-coated portion which is formed in an arbitrary shape on a sliding portion thereof and a coated portion which is formed on a sliding portion thereof other than the sliding portion on which the non-coated portion is formed, wherein the non-coated portion has a plurality of streaks, and the coated portion and the non-coated portion are formed in such a manner that the coated portion is formed by printing except for the non-coated portion, wherein said streaks are formed in curves and extend upward from a lower end portion of said skirt portion to a central portion thereof when said skirt portion is viewed laterally.

16. A piston for an internal combustion engine, comprising:

a land portion; and a skirt portion including a non-coated portion which is formed in an arbitrary shape on a sliding portion thereof and a coated portion which is formed on a sliding portion thereof other than the sliding portion on which the non-coated portion is formed, wherein said non-coated portion includes a plurality of streaks which are formed parallelly and independently of each other, and which are disposed symmetrically on both upper and lower end portions of said skirt portion when said skirt portion is viewed laterally, wherein said streaks are formed in arcs and extend downward from said upper end portion of said skirt portion and upward from said lower end portion thereof to a central portion thereof when said skirt portion is viewed laterally.

17. A piston for an internal combustion engine, comprising:

a land portion; and a skirt portion including a non-coated portion which is formed in an arbitrary shape on a sliding portion thereof and a coated portion which is formed on a sliding portion thereof other than the sliding portion on which the non-coated portion is formed, wherein the non-coated portion has a plurality of streaks, and the coated portion and the non-coated portion are formed in such a manner that the coated portion is formed by printing except for the non-coated portion, wherein said streaks are formed in arcs and extend downward from an upper end portion of said skirt portion to a central portion thereof when said skirt portion is viewed laterally.

* * * * *